United States Patent [19]

Moreau

[11] Patent Number: 4,734,078

[45] Date of Patent: Mar. 29, 1988

[54] LIQUID BRASSIERE

[76] Inventor: James O. Moreau, 5233 Seminary Rd., Alexandria, Va. 2231

[21] Appl. No.: 893,729

[22] Filed: Aug. 6, 1986

[51] Int. Cl.[4] ..... A41C 3/00

[52] U.S. Cl. ..... 450/38

[58] Field of Search ..... 128/461, 462; 450/37, 450/38

[56] References Cited

U.S. PATENT DOCUMENTS

| | | | |
|---|---|---|---|
| 2,544,300 | 3/1951 | Davenport | 128/462 |
| 2,748,771 | 6/1956 | Richards | 128/461 |
| 2,764,759 | 10/1956 | Gazelle | 450/38 |
| 3,600,718 | 8/1971 | Boone | 128/462 |
| 3,845,507 | 11/1974 | Kirby et al. | 128/462 |
| 4,308,869 | 1/1982 | Boyen | 128/462 |

FOREIGN PATENT DOCUMENTS

| | | | |
|---|---|---|---|
| 1008224 | 5/1957 | Fed. Rep. of Germany | 128/462 |
| 324870 | 2/1930 | United Kingdom | 128/462 |

*Primary Examiner*—Werner H. Schroeder

[57] ABSTRACT

A brassiere which maintains a liquid, such as water, in contact with or very close to the breast such that a bouyant force provides improved and independent support for each breast. The invisibly supported breast has a rounded, firm and youthful appearance. Methods are described for varying the shape and appearant size of the breast and for providing additional beauty and health benefits. A transparent version is provided to facilitate incorporating the breast's improved appearance into many forms of fashion statement.

19 Claims, 6 Drawing Figures

LIQUID BRASSIERE

BACKGROUND—FIELD OF INVENTION

This invention relates generally to brassieres and specifically to an improved means for supporting the breasts.

BACKGROUND—DESCRIPTION OF PRIOR ART

Prior art in the development of the brassiere has focused on using fabric cups to support and shape the breast. There are some notable deficiencies in the prior art. Women who do not want their breasts constrained by cups have had few alternatives but to do without the support of a brassiere. Also, a brassiere which is comfortable and properly supportive in quiescent conditions may provide inadequate support during intense activity such as jogging, playing sports, etc. Furthermore, some women like to expose part or all of their breasts as a statement of fashion, but women with sagging breasts have felt esthetically unable to participate in this fashion statement.

Prior art teaches some other significant problem areas with traditional brassieres. U.S. Pat. 4,416,284 Nos. (Fink 11/83), 4,413,625 (Footer 11/83), 4,127,135 (Stern 11/78), and 3,949,760 (Baranowski and Malinowski 4/76) review the need for proper breast support while permitting separate movement of each breast. U.S. Pat. Nos. 4,388,931 (Farino 6/83), 4,314,569 (Speno 2/82) and 3,746,008 (Locascio and Astor 7/73) discuss irritations and discomforts caused by traditional brassieres. U.S. Pat. Nos. 4,393,875 (O'Boyle and Shonk 7/83) and 3,826,266 (Alpert 7/74) detail problems with obtaining the proper fit with traditional brassieres.

Although no prior art has been found which directly pertains to the invention of the liquid brassiere, there are several notable references. U.S. Pat. No. 4,241,737 (Schmidt 12/80) discusses the desirability of simulated nipples to enhance the attractiveness of a traditional brassiere. U.S. Pat. No. 3,934,593 (Mellinger 1/76) discusses the use of an adhesive to attach a brassiere to the user's skin. U.S. Pat. No. 3,490,459 (Story 1/70) discloses a traditional brassiere with transparent breast cups. U.S. Pat. No. 3,446,213 (Goldman 5/69) discusses traditional brassieres manufactured of a plastic material.

OBJECTS AND ADVANTAGES

One object of this invention is solving the problems with traditional brassieres by using a novel approach. The liquid brassiere provides an improved breast support technique whereby the breast is surrounded by a liquid such as water or a medicinal lotion and is then supported by the bouyancy of the displaced liquid. The amount of support can be increased by using a liquid with a greater density. The breasts would not be constrained by cups and would have substantial freedom to move independently of each other while still being fully supported on all surfaces by the liquid. Problems associated with fitting the proper cup size and irritations due to cup construction are minimized by the liquid brassiere.

Another important object of this invention is to assist the breasts into achieving a most attractive shape. Since the breasts are uniformly supported by liquid their shape will be uniquely determined by the structure of each individual breast. Typically, a breast supported by liquid will yield a shape which appears to be rounded, firm, youthful, and very attractive. A transparent liquid brassiere is the perfect solution for a woman who wants to display part or all of her breasts while they are invisibly supported into their most flattering shape. By simply changing liquid pressure, a woman could easily increase or decrease the visible size of her breasts while wearing a liquid brassiere. A translucent or opaque liquid brassiere decorated with suitable colors and patterns would be appropriate for direct use as a halter, a swim suit top, or in many other fashion applications.

The major advantages of the preferred embodiment are that it will be inexpensive to manufacture and easy to use. The simplest form of the liquid brassiere consists of an appropriately sized moulded plastic chamber for each breast, suitable straps for holding the chambers to the chest, a sealant or adhesive or two sided tape for temporarily sealing the chambers to the skin so the liquid does not exscape, and a means for filling the chambers with liquid after they are sealed to the skin. Each woman would select a chamber size which is shaped similar to and only slightly larger than her breast so that very little liquid would be needed to fill the remaining chamber volume and so that little extra weight is added. The combined weight of the chambers, the liquid, and the breasts would be transmitted by the straps to the woman's shoulders. The liquid would exert a pressure equivalent to only a few inches of water against the skin sealants so leak protection would not be difficult. The chambers and their interconnection would be flexible so they would adapt to body movements. The chambers could be either soft to feel natural, or hard to protect the breasts during hazardous activities such as contact sports. Finally, the breast chambers could be two seperate pieces or they could be moulded into a single plastic shell.

The major advantages of the alternate embodiment are that no adhesive would need to be applied to the skin and that no liquid would contact the breast. The alternate embodiment of the liquid brassiere would still provide full liquid support to the breast. This is accomplished with a soft and flexible inner breast cup having a plastic outer layer which is sealed into the breast chamber such that the liquid between the chamber and cup is prevented from exscaping. The inner cup per se will not be required to support or shape the breast as would be done with a traditional brassiere. Instead, the fluid transmits a bouyant supporting force to the breast through the cup. This liquid brassiere can be permanently filled or it can be designed to be refillable with liquids of different densities depending on the degree of support desired by the user.

Those skilled in the art will readily see that the above description is only a partial listing of features and functions which are either not existant in the traditional brassiere or are substantially improved upon by the liquid brassiere. Further objects and advantages of my invention will become apparent from a consideration of the drawings and ensuing description thereof.

DESCRIPTION OF DRAWINGS

FIG. 5 is shown before the breast chamber is filled with liquid to provide breast support, so the outline of an unsupported breast is also shown.

FIG. 6 also illustrates the side view of the permanently filled version of the alternate embodiment.

DETAILED DESCRIPTION OF THE PREFERED EMBODIMENT

Figure 1:
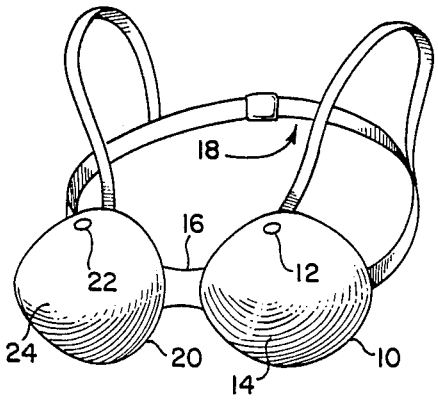
FIG. 1 is an overview which shows that the external appearance of a liquid brassiere is very similar to a traditional brassiere.

FIG. 1 shows an overview of a liquid brassiere. Breast chambers 10 and 20 are attached to each other with any desired degree of interconnection 16 from being almost completely independent to being rigidly attached to each other. The liquid brassiere is supported by suitable straps and fasteners 18. Each breast chamber contains, without contacting, one breast of the user, not shown. The volume 14 and 24, shown empty, between the breast and the breast chambers 10 and 20 will be filled with liquid, not shown, through the breast chamber fill holes 12 and 22.

Figure 2:
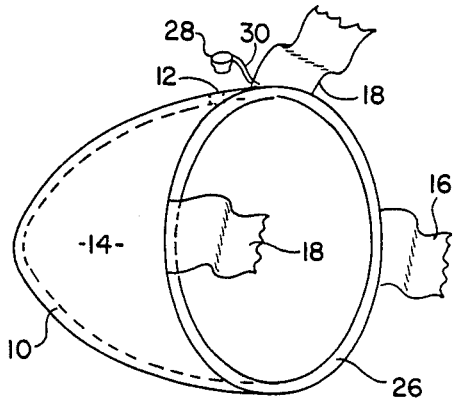
FIG. 2 is an expanded view of the prefered embodiment of one breast chamber.

FIG. 2 shows an expanded view of a breast chamber 10 seen from the side which seats against the user's chest, not shown. The breast chamber 10 might be fabricated as a single piece of molded plastic with any desired degree of rigidity from soft so as to feel natural to hard as to protect the breast during hazardous activities. Suitable structure 16 for interconnection to the companion breast chamber, not shown, and straps 18 for supporting the breast chamber 10 are shown in fragment. A sealant consisting of an adhesive or two sided tape 26 is shown applied to the surface which seats against the user's chest, not shown. The volume 14, shown empty, will be filled through the breast chamber fill hole 12. The plug 28 attached 30 to the breast chamber 10 can be used to plug the breast chamber fill hole 12.

OPERATION OF THE PREFERED EMBODIMENT

FIG. 2 illustrates an empty breast chamber 10 which has a sealant 26 applied to its opening. The user would insert her breast into the breast chamber 10 so that the sealant 26 will seal to the skin surrounding the breast and the straps 18 would be properly positioned to support the brassiere against the user's chest. A liquid, not shown, such as water or a lotion to beautify the skin of the breast or a medicine solution to provide health benefits to the user or to a nursing baby would then be poured through the breast chamber fill hole 12 so as to fill the previously empty breast chamber volume 14. After inserting the plug 28 to cap the fill hole 12, the liquid would be unable to leak out of the breast chamber 10 until the user breaks the sealant 26 to remove the brassiere.

Figure 3:
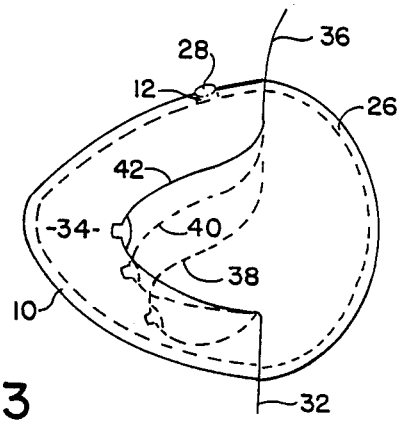
FIG. 3 is a side view of the prefered embodiment of an oversized breast chamber filled with liquid and shows the outlines of a breast which is supported by liquids which have different densities.

FIG. 3 shows a side view of a breast chamber 10 which is shown oversized to illustrate the operating principle. The sealant 26 has been attached to the skin surrounding the breast from upper chest 36 to lower chest 32 and the support straps, not shown, have been properly positioned. The outline 38 of an unsupported breast is shown before the breast chamber volume 34 is filled with liquid. The liquid, not shown, is poured through the fill hole 12 to fill the volume 34 and the fill hole 12 is then plugged 28 as shown. The liquid will generate an upward bouyant force on the breast due to the displacement of a volume of liquid equivalent to the volume of the breast. If the displaced volume is constant, the total bouyant force is directly proportional to the density of the liquid. If the volume 34 were filled with a low density liquid, such as distilled water, then a relatively smaller bouyant force would modestly support the breast as shown in the middle breast outline 40. If, instead, the volume 34 had been filled with a higher density liquid such as water with dissolved salts, then a stronger bouyant force would highly support the breast as shown in the top breast outline 42. The liquid could be transparent so as to invisibly support the liquid into a most attractive shape. The breast chamber 10 could be manufactured with any desired light transmission characteristic from transparent through translucent to opaque so as to enable the user to select any desired degree of breast visibility. The breast chamber 10 can also be manufactured to contain an infinite number of combinations of colors and patterns thus making the liquid brassiere suitable for use as a swim suit top or a complete outter garmet with high fashion applications.

Figure 4:
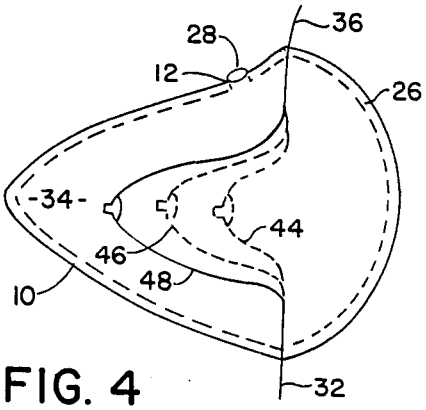
FIG. 4 is a side view of the prefered embodiment of an oversized breast chamber filled with liquid and shows the outlines of a breast which is subjected to liquids which have different internal pressures.

FIG. 4 also shows a side view of an oversized breast chamber 10 which is sealed 26 to the skin 32 and 36 surrounding the breast and the support straps, not shown, are appropriately positioned. The breast chamber volume 34 is filled with a liquid, not shown, and the fill hole 12 is plugged 28. The middle breast outline 46 shows a breast supported by the liquid at normal atmospheric pressure. If the liquid pressure were increased, the appearant size of the breast would decrease as shown in breast outline 44. This increase in pressure could be accomplished, for example, by tightening the straps, not shown, after the volume 34 is filled with liquid and thereby compressing the liquid. If, instead, the liquid pressure were decreased, the appearant size of the breast would increase as shown in breast outline 48. Decreasing the pressure within a semi-rigid breast chamber 10 is easily accomplished by externally squeezing by hand the chamber 10 while it is being filled, then releasing the external compression after the fill hole 12 is plugged 28. The breast chamber 10 will attempt to elastically expand to its original size thereby decreasing the liquid pressure and increasing the appearant size of the breast while the liquid brassiere is being worn.

DETAILED DESCRIPTION OF AN ALTERNATE EMBODIMENT

Figure 5:
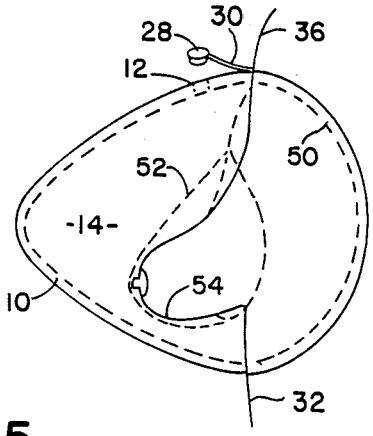
FIG. 5 is a side view of the alternate embodiment of an oversized breast chamber in which the breast does not contact the liquid and no adhesive is applied to the skin.

FIG. 5 shows a side view of an oversized breast chamber 10 of an alternate embodiment in which the breast does not contact the support liquid and the breast chambers are not sealed to the skin. As in the prefered embodiment. FIG. 5 shows a breast chamber volume 14, shown empty, a fill hole 12 and a plug 28 attached to the breast chamber 10. However, FIG. 5 also contains an inner cup 52 which is permanently sealed 50 around the breast chamber 10 so that liquid cannot leak around the inner cup 52. Both the breast chamber 10 and the inner cup 52 are constructed so as to have at least one layer of liquid impenetrable material, such as plastic, which covers all surfaces exposed to the liquid, not shown, so that liquid cannot leak through the brassiere. When not plugged 28, the liquid fill hole 12 could be used to empty fluid out of the breast chamber volume 14. Also illustrated in FIG. 5 is the outline 54 of a breast which is not properly supported when the volume 14 is not filled as illustrated.

OPERATION OF THE ALTERNATE EMBODIMENT

Figure 6:
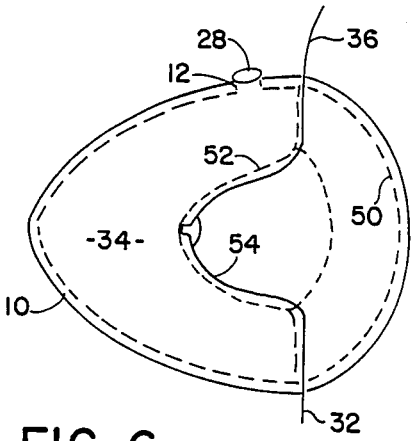
FIG. 6 is the same as FIG. 5 except that FIG. 6 is shown after the breast chamber is filled with liquid so that the breast is properly supported as shown by the outline of the supported breast.

FIG. 6 shows a side view of an oversized breast chamber 10 of an alternate embodiment with the supporting straps, not shown, appropriately positioned. The breast chamber volume 34 has been filled and the fill hole 12 has been plugged 28. The fluid, not shown, exerts a bouyant force against the inner cup 52 which transmits that force to the now properly supported breast shown in outline 54. Note that the inner cup 52 provides neither support nor shape, but simply transfers the liquid's supporting force to the breast which determines its own optimum shape. A permanently filled version of this alternate embodiment would be a simple extension of FIG. 6 in which the breast chamber 10 would be manufactured such that the volume 34 would be filled and the fill hole 12 would be permanently plugged 28 or totally deleted so that the liquid, not shown, would have no exscape path.

While the above description contains many specifics, the reader should not contrue them as limitations on the scope of the invention, but rather as an exemplification of one preferred embodiment thereof. Those skilled in the art will envision many other possible variations which are within the scope of this invention. For example, a different means for filling the breast chambers, a means for supporting a woman's breasts when they are not of the same size, having the adhesive only partially surround the breasts or surround both breasts togeather instead of seperately, other strap and structure configurations for positioning and supporting the breast chambers, and a different means than adhesive to prevent a liquid from leaking around the breast chambers. Accordingly the reader is requested to determine the scope of this invention by the appended claims and their legal equivalents, and not by the examples which have been given.

I claim:

1. A brassiere which comprises in combination: a liquid; and a means for maintaining said liquid in close proximity to a woman's breasts such that said liquid provides bouyancy and support to said breasts.

2. The brassiere of claim 1 further comprising:

breast chambers whereby said breasts are contained;

a means for retaining said liquid within said breast chambers and in contact with said breasts whereby said liquid contributes direct bouyant support to said breasts;

a means for filling said breast chambers with said liquid; and a means for supporting the weight of said brassiere and said breasts.

3. The brassiere of claim 2 further comprising a means for changing the density of said liquid so as to change the amount of said support to said breasts whereby said support will increase when said density is increased and will decrease when said density is decreased.

4. The brassiere of claim 2 further comprising a means for changing the pressure within said liquid so as to change the appearant size of said breasts whereby said size will increase when said pressure is reduced and will decrease when said pressure is increased.

5. The brassiere of claim 2 further comprising a means for changing the composition of said liquid so as to provide additional benefits beyond said support to said breasts whereby said composition consisting of lotions will beautify said breasts and said composition consisting of medicines will provide health benefits to said breasts.

6. The brassiere of claim 2 in which said means for retaining said liquid within said breast chambers further comprises: a liquid impenetrable material, such as plastic, which covers all surfaces of said breast chamber that are exposed to said liquid whereby said liquid will be unable to leak through said breast chambers; and a sealant, such as an adhesive, which seals said breast chambers to the skin around said breasts whereby said fluid will be unable to leak around said breast chambers.

7. The brassiere of claim 2 wherein said breast chambers are constructed with any desired degree of translucence from transparent through opaque.

8. The brassiere of claim 2 wherrein said breast chambers are constructed with any desired combinations of color and pattern.

9. The brassiere of claim 2 wherein said breast chambers are constructed with any desired degree of rigidity from soft, whereby said breast chambers will feel natural, through hard, whereby said breast chambers will provide protection for said breasts during hazardous activities such as contact sports.

10. The brassiere of claim 2 wherein said breast chambers are constructed with any desired degree of interconnection from said breast chambers having almost complete independence from each other through said breast chambers being rigidly attached to each other.

11. The brassiere of claim 1 further comprising:

breast chambers;

inner cups which hold said breasts;

a means for retaining said liquid within said breast chambers and surronding the outside of said inner cups whereby said liquid contributes indirect support to said breasts by transmitting a bouyant force through said inner cups to said breasts; and a means for supporting the weight of said brassiere and said breasts.

12. The brassiere of claim 11 in which said means for retaining said liquid within said breast chambers and surronding the outside of said inner cups further comprises: a liquid impenetrable material, such as plastic, which covers all surfaces of said breast chambers and said inner cups that are exposed to said liquid whereby said liquid will be unable to leak through said breast chambers or said inner cups; and a means for sealing the outter perimeter of said inner cups to said breast chambers so as to form an enclosed volume whereby said liqud will be unable to leak around said inner cups.

13. The brassiere of claim 11 in which said breast chambers further comprise a means for filling and emptying said liquid into and out of said breast chambers.

14. The brassiere of claim 11 in which said breast chambers are constructed so as to be permanently filled with said liquid.

15. The brassiere of claim 11 further comprising a means for changing the density of said liquid so as to change the amount of said support to said breasts whereby said support will increase when said density is increased and will decrease when said density is decreased.

16. The brassiere of claim 11 wherein said breast chambers and said inner cups are constructed with any desired degree of translucence from transparent through opaque.

17. The brassiere of claim 11 wherein said breast chambers and said inner cups are constructed with any desired combinations of color and pattern.

18. The brassiere of claim 11 wherein said breast chambers are constructed with any desired degree of rigidity from soft, whereby said breast chambers will feel natural, through hard, whereby said breast chambers will provide protection for said breasts during hazardous activities such as contact sports.

19. The brassiere of claim 11 wherein said breast chambers are constructed with any desired degree of interconnection from said breast chambers having almost complete independence from each other through said breast chambers being rigidly attached to each other.

* * * * *